US005085346A

United States Patent [19]

Wright

[11] Patent Number: 5,085,346

[45] Date of Patent: Feb. 4, 1992

[54] FLUID DISPENSING KIT

[76] Inventor: Danny J. Wright, P.O. Box 9680, Amarillo, Tex. 79105

[21] Appl. No.: 635,400

[22] Filed: Dec. 21, 1990

Related U.S. Application Data

[63] Continuation of Ser. No. 294,054, Jan. 5, 1989, abandoned.

[51] Int. Cl.[5] ..... B67D 5/60

[52] U.S. Cl. ..... 222/143; 222/156; 222/183; 220/254; 229/120.03

[58] Field of Search ..... 222/183, 185, 184, 143, 222/129, 23, 156, 206, 215; 206/223, 503; 220/20, 22; 229/915, 126, 120.02, 120.03; 141/94, 18

[56] References Cited

U.S. PATENT DOCUMENTS

| | | | |
|---|---|---|---|
| 2,073,930 | 3/1937 | Gray | 141/94 |
| 2,134,865 | 11/1938 | Essers | 222/143 |
| 3,186,622 | 6/1965 | Palmer | 229/120.03 |
| 3,234,107 | 2/1966 | Kaufman et al. | 220/22 |
| 3,331,533 | 7/1967 | Krugger | 222/183 |
| 3,349,960 | 10/1967 | Ketler | 222/183 |
| 3,453,033 | 7/1969 | Goss | 222/183 |
| 3,964,636 | 6/1976 | Rehrig | 222/143 |
| 4,412,616 | 11/1983 | Williams | 220/22 |
| 4,418,823 | 12/1983 | Rosnick | 220/22 |

*Primary Examiner*—Robert P. Olszewski
*Assistant Examiner*—Kenneth Noland
*Attorney, Agent, or Firm*—Crutsinger & Booth; James O. Dixon

[57] ABSTRACT

A kit for facilitating bulk shipment, storage and dispensing of fluids, comprising in combination: a carton having an internal cavity divided into a main chamber and a second chamber; a first deformable flap for providing a reclosable first passageway into the main chamber; a second deformable flap for providing a reclosable passageway into the second chamber; a window rendering a portion of the main chamber visible from outside the carton; a transparent collapsible container positioned inside the main chamber for storing and dispensing fluids; a retractable/extendable dispensing spigot communicating with the interior of the container; and a transparent portable dispenser removably housed in the second chamber. The dispensing spigot is extendable from a first, shipping position, wherein it is retracted to a position within the main chamber to a second, dispensing position, wherein it is extended through the first passageway and secured in the extended position by the first deformable flap. A transparent portable dispenser is removably housed in the second chamber of the carton and accessible via the second passageway. The kit is adaptd to facilitate color differentiation of a plurality of fluids, each fluid having a different color; its color being visible through the window, the transparent container, and the transparent portable dispenser. Markings are provided designating the contents and proper use of the particular fluid contained in the kit; the markings conforming in color to the color of the fluid stored therein.

16 Claims, 4 Drawing Sheets

FLUID DISPENSING KIT

This is a continuation of application Ser. No. 07/294,054 filed Jan. 5, 1989 now abandoned.

FIELD OF THE INVENTION

The present invention relates to the handling of bulk industrial fluids and more particularly relate to a self-contained shipping, storage and dispensing container for industrial cleaning fluids.

BACKGROUND OF THE INVENTION

Businesses, restaurants and industrial facilities utilize a wide variety of solvents, cleaning fluids and other janitorial supplies. The large volume of cleaning fluids, etc. , required for commercial facilities dictates the purchase and storage of these fluids in bulk quantities. Fluid from bulk containers or barrels is then transferral in small amounts to smaller containers for use remote from the storage container.

Unfortunately, fluids are often transferred into unmarked containers. The result being that fluids in portable containers are difficult to differentiate and are misused, misplaced or stored in a hazardous fashion. To worsen matters, many industrial fluids cannot be differentiated on the basis of color alone and can be dangerous to the individual who tries to differentiate fluids on the basis of smell.

The object of the present invention is to provide a kit for facilitating the proper and safe use of industrial cleaning fluids which reduces the danger of misuse.

Another object of the invention is to provide a kit for facilitating the storage and dispensing of bulk industrial fluids which is more easily shipped and less expensive than conventional containers.

SUMMARY OF THE INVENTION

A kit for the shipment, storage and dispensing of fluids and adapted to provide for color differentiation of different types of fluids; each fluid type having a different color which is visible from outside the kit. The kit of the present invention has a rigid carton enclosing a transparent collapsible container for storage and dispensing of fluids. The collapsible container is equipped with a dispensing spigot extendable from a first shipping position wherein it is retracted within the carton, to a second dispensing position wherein it is extended through a passageway in the carton and secured in the extended position by a deformable flap. The carton is provided with a window rendering a portion of the transparent collapsible container visible from outside the carton, whereby the color of the fluid contained therein is immediately ascertainable.

The carton is sealed, the internal cavity thereof being divided into a main chamber and a second chamber. The collapsible container is adapted to be secured within the main chamber. The second chamber serves as a receptacle for storage of a portable dispensing apparatus; the dispensing apparatus being refillable with fluid stored in the collapsible container. The portable dispenser is removably housed in the second chamber and accessible via a second deformable flap for providing a reclosable second passageway into the carton.

According to a preferred embodiment, the carton is formed from non-permeable sheet material.

The kit of the present invention is adapted to be used in combination with similar kits, each kit containing a different type of fluid; each fluid type having a different color, whereby fluid types may be differentiated on the basis of the fluid color visible through the window of the carton.

In furtherance of the aims and objects of the present invention, the carton is provided with markings designating the type and proper use of the particular fluid contained therein; the markings conforming in color to the color of the particular fluid.

Other objects and advantages of the invention will be explained in greater detail below.

BRIEF DESCRIPTION OF THE DRAWINGS

For a full understanding of the preferred embodiment of the present invention, reference may be had to the following detailed description taken in conjunction with the accompanying drawings in which.

Like numerals are used to designate like parts in all FIGURES of the drawings.

DETAILED DESCRIPTION OF A PREFERRED EMBODIMENT

Figure 1:
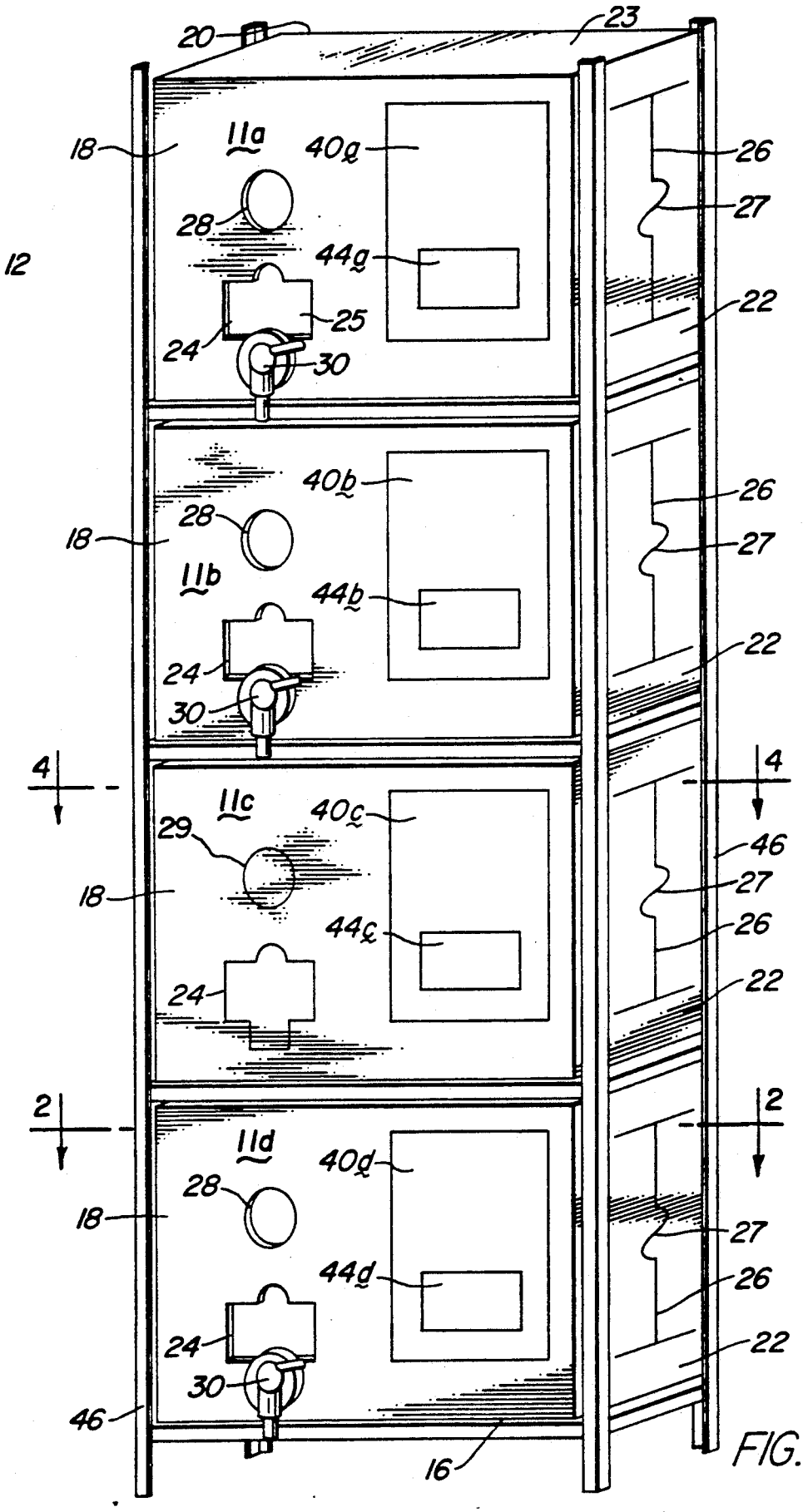
FIG. 1 is a perspective view of a plurality the combination fluid storage and dispensing units of the present invention in a storage rack.

Turning to FIG. 1 a plurality of combination kit units 11 of the present invention are shown as they may be placed in an arrangement, designated generally as 12, for storage and periodic dispensing and use of the fluid contents of each unit 11. According to the preferred embodiment the storage arrangement 12 comprises a plurality of individual kits 11*a*–11*d* each containing a different type of fluid 42 and stackable in a rack 46.

Figure 2:
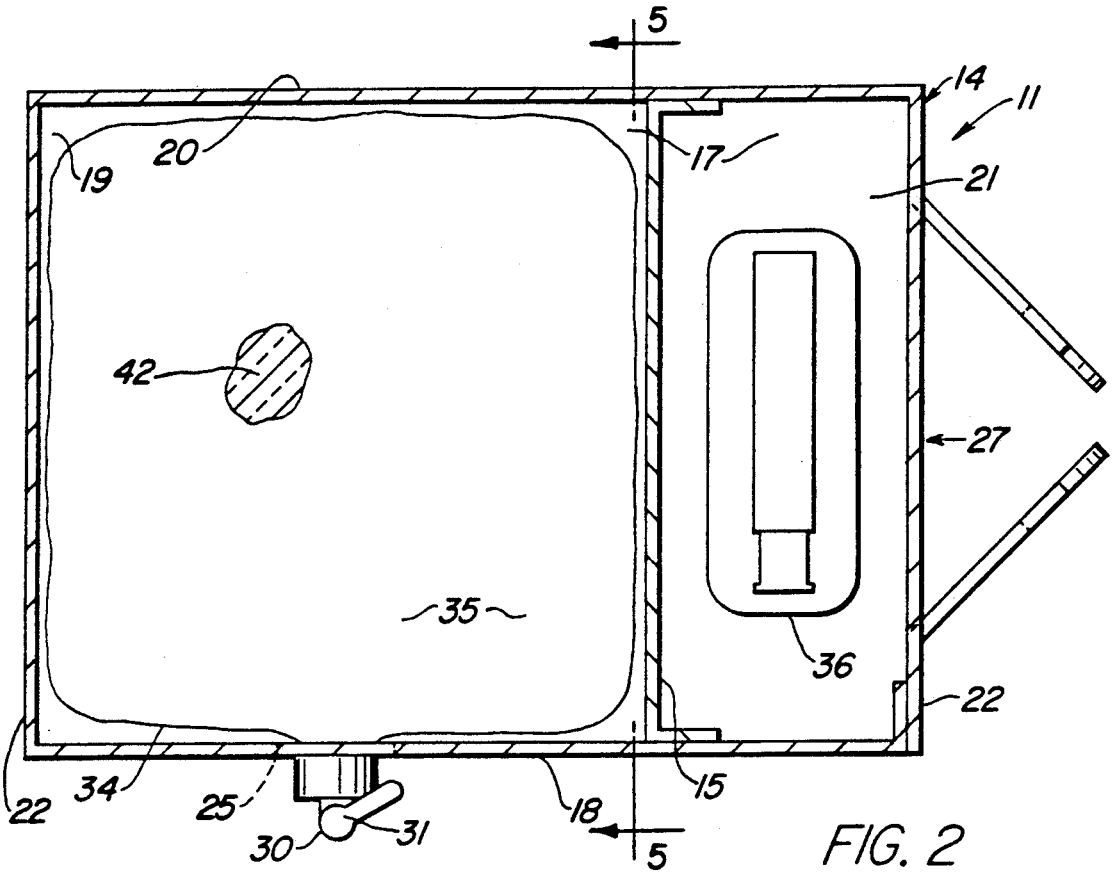
FIG. 2 is a sectional view of the kit of the present invention taken along lines 2—2.

Referring to FIGS. 1 and 2, each kit 11 comprises a carton 14 having a substantial flat bottom surface 16, a face panel 18, a rear panel 20, a pair of side panels 22 and a substantially flat top 23. According to a preferred embodiment, carton 14 is formed from rigid sheet material, for example cardboard and has a substantially flat bottom surface 16 for allowing carton 14 to be supported on a shelf or rack 46. Carton 14 is preferably formed from non-permeable sheet material, or otherwise rendered moisture-resistant, such as, for example, by the application of a laminant or a plastic shrink wrap.

Figure 3:
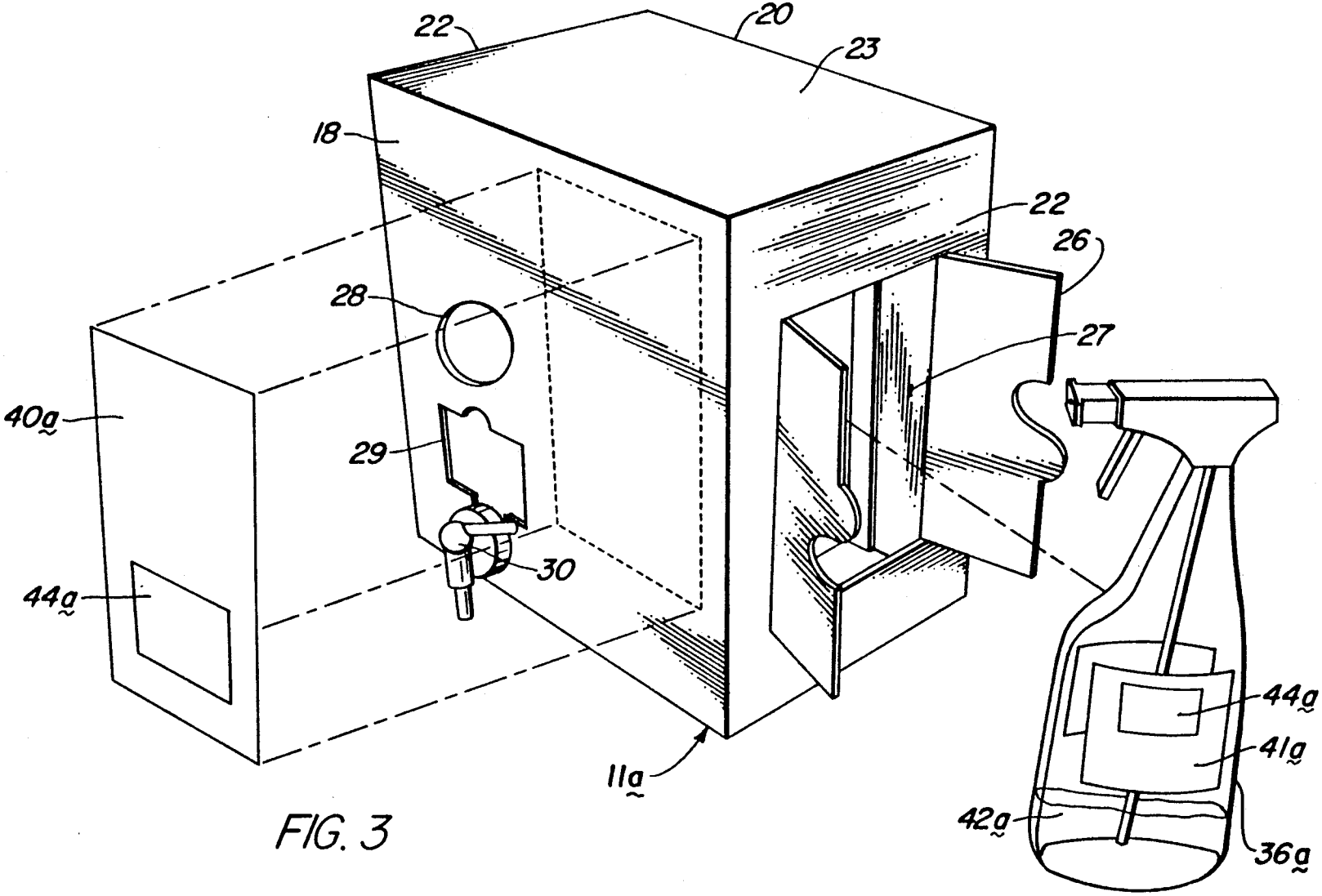
FIG. 3 is an exploded view of the kit of the present invention shown in FIG. 1.

Carton 14 is preferably closed and permanently sealed, enclosing an internal cavity 17. As best shown in FIG. 2, a partition 15 divides cavity 17 into a main chamber 19 and a second chamber 21. A first deformable flap 24 is formed in face panel 18 by a series of perforations (not shown) for providing a reclosable first passageway 25 through face panel 18 into main chamber 19. A second deformable double flap 26 is formed in one side panel 22 by perforations (not shown) for providing a reclosable second passageway 27 through side panel 22 into second chamber 21. A visual indicator window 28 is formed in face panel 18 for rendering a portion of main chamber 19 visible from outside of carton 14. According to a preferred embodiment, window 28 may be formed adjacent first passageway 25 by the substitution of a detachable flap 29 instead of first deformable flap 24 as shown in FIG. 3.

A collapsible container 34 is positioned within main chamber 19, a portion of collapsible container 34 being adjacent window 28 and first passageway 25. Collapsible container 34 is preferably formed from non-permeable transparent flexible sheet material and permanently sealed, forming a reservoir for the storage and dispensing of fluids 42. Collapsible container 34 is provided with a selectively operable, fluid dispensing spigot 30 for dispensing fluid 42 contained within the interior 35 of collapsible container 34.

Figure 4:
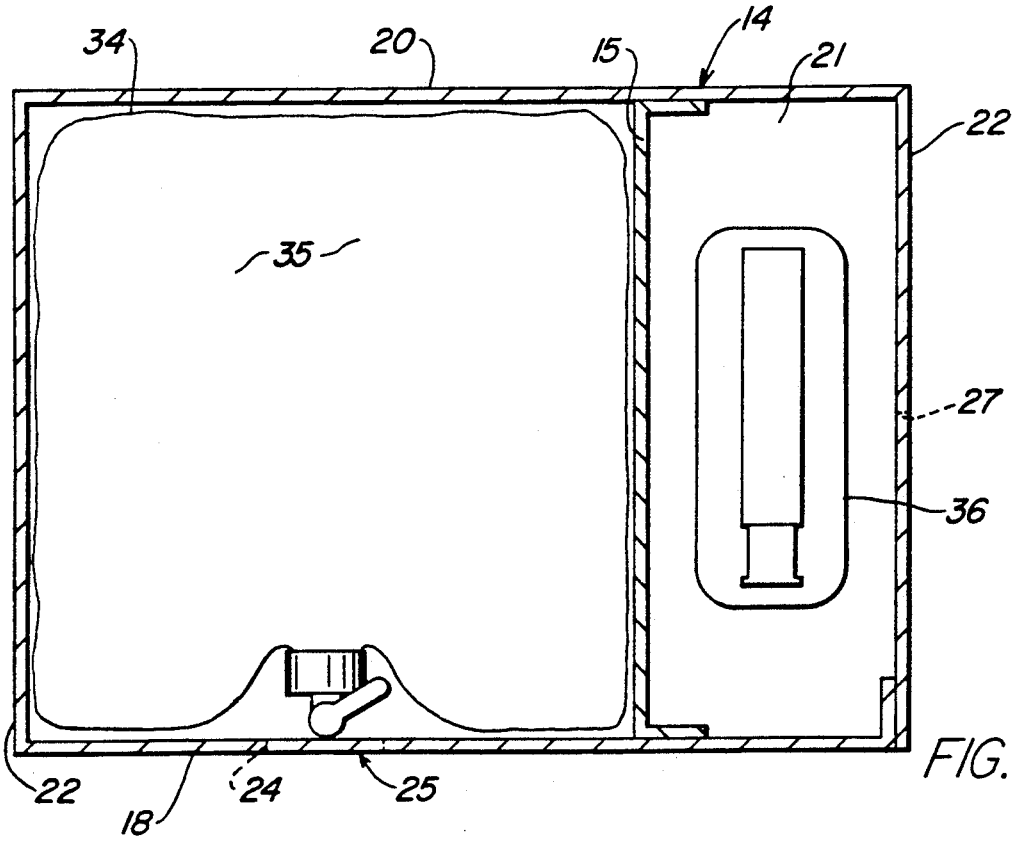
FIG. 4 is a sectional view of the kit of the present invention taken along lines 4—4.

Spigot 30 is preferably extendable from a first shipping position, shown in FIG. 4, wherein spigot 30 is retracted to a position within main chamber 19 for facilitating shipping and storage of kit 11. Spigot 30 is extendable from the first shipping position shown in FIG. 4, to a second fluid dispensing position, shown in FIGS. 1, 2 and 3, wherein spigot 30 is extended through first passageway 25 to a position outside of carton 14. According to a preferred embodiment, spigot 30 is securable in the extended fluid dispensing position by first deformable flap 24; first deformable flap 24 being reinsertable between valve bodies 31 of spigot 30 and first passageway 25 for preventing the accidental retraction of spigot 30 to its first shipping position within main chamber 19. Valve body 31 of spigot 30 is preferable formed of transparent material for providing that the color of the particular fluid 42 dispensed therethrough is visible from outside of carton 14.

Turning to FIG. 1, the combination unit 12 is adapted to provide for the storage and dispensing of a plurality kits 11*a*, 11*b*, 11*c*, and 11*d* of industrial bulk fluids 42, each fluid 42 being provided with a different coloring agent for providing color differentiation across varying types of fluids. Thus, fluid 42 in kit 11*a* having a particular coloring agent, for example, red, may be visually differentiated from fluid 42 in kit 11*b* having a different coloring agent. The color of fluids 42 and stored in collapsible containers 34 in respective kits 11 will be visible through windows 28 and transparent valve bodies 31 of spigots 30.

Each kit 11 is also provided with markings 40 applied to face panel 18 and designating the contents and proper use of the particular fluid 42 stored within collapsible container 34 of respective kits 11*a–d*. Markings 40*a–d* preferably conform the color of fluid 42 stored within collapsible container 34 of each of the individual kits 4*a–d* respectively.

According to a preferred embodiment, markings 42*a–d* include a pictorial illustrations 44*a–d* of the intended use of the particular fluid 42 contained in each of the individual kits 11*a–d*, respectively. Pictorial illustrations 44*a–d* preferably conforms in color to the particular color of the fluid 42 stored in each individual kits 11*a–d* respectively.

A portable dispenser 36 is removably housed within second chamber 21 of each individual kit 11. Portable dispenser 36 is preferably formed of a non-permeable transparent material and has a smaller volume than collapsible container 34. Portable dispenser 36 is adapted to be refillable from collapsible container 34 for facilitating the transportation and use of small quantities of the particular fluid 42 stored in collapsible container 34, at remote locations. Portable dispenser 36 is preferably transparent for rendering the particular color of the particular fluid 42 contained therein, visible from outside of portable dispenser 36. According to a preferred embodiment, color-markings 41 are applied to portable dispenser 36 designating the contents and proper use of the particular fluid 42 contained in portable dispenser 36; said color markings conforming in color to the color of the particular fluid 42 stored in collapsible container 34 of the individual kit 11. Color markings 41 preferably include a pictorial illustration of the intended use of the particular fluid 42 contained in each portable dispenser 36; pictorial illustration 44 conforming in color to the color of the particular fluid 42 contained therein.

Figure 5:
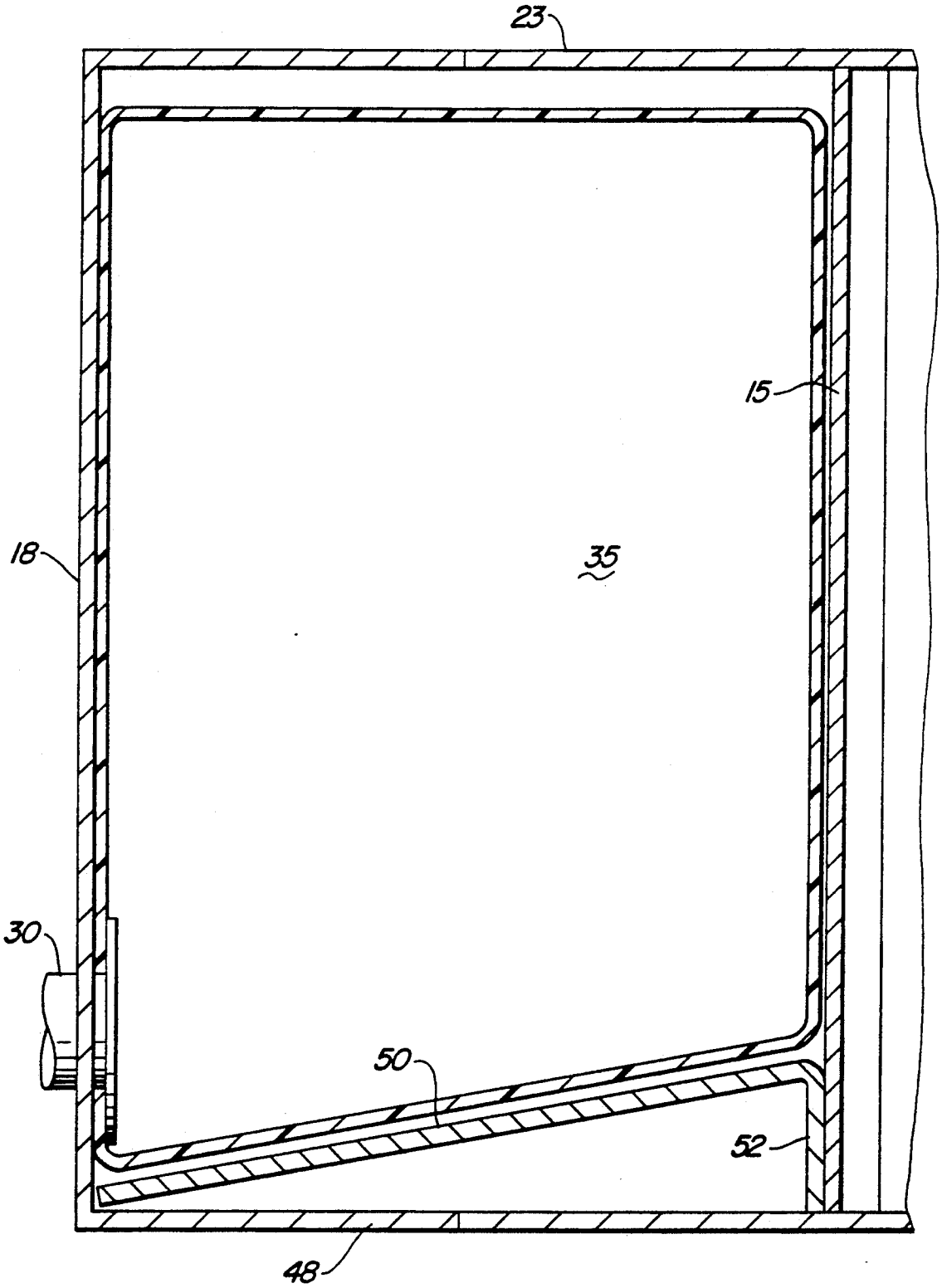
FIG. 5 is a cross-sectional view of the kit taken along lines 5—5 of FIG. 4.

As illustrated in FIG. 5, an inclined surface 50 is supported by a downwardly extending leg 52 which engages the bottom wall 48 of carton 14. Container 34 rests on inclined surface 50 to facilitate gravity flow of substantially all of the contents of container 34 toward spigot 30.

Portable dispenser 36 is removably stored in second chamber 21 of carton 14 and accessible from outside of carton 14 via second passageway 27 formed by second deformable flaps 26; second chamber 21 providing a receptacle for storage of portable dispenser 36 during nonuse. According to a preferred embodiment, second chamber 21 is of sufficient size to accommodate storage of other accoutrements, such as gloves, sponges, etc. which may be required for the proper use of the fluid in addition to providing storage area for portable dispenser 36.

What is claimed is:

1. In a shipping and storage carton for fluid materials of the type comprising a sealed collapsible non-permeable bag-like fluid storage container housed and supported within an essentially rigid box-like container adapted for flat-shelf storage and a dispensing spigot connected to said fluid container and accessible outside said rigid container, the improvement comprising: a storage compartment provided within said rigid container separated from said fluid container by an essentially rigid wall separating and excluding said fluid container from said storage compartment, said storage compartment being accessible from the exterior of said rigid container without disturbing said fluid container; a portable dispenser of smaller capacity than said fluid container adapted to be removably housed in said storage compartment and to be fillable and refillable with fluid from said fluid container through said dispensing spigot, at least a portion of said spigot being comprised of a material transmissive of the color of the fluids stored in said fluid storage container; and said portable dispenser being comprised of a material transmissive of the color of the fluid contained therein such that the color of the fluid in said portable dispenser may be visually compared with the color of the fluid in said fluid storage container.

2. In a shipping and storage carton as defined in claim 1 the further improvement wherein labelling materials are affixed to said rigid container and to said portable dispenser having coloring identifiably the same as the color of fluid in said fluid storage container.

3. In a shipping and storage carton as defined in claim 2 the further improvement wherein labelling materials are affixed to said rigid container and to said portable dispenser having pictorial illustration of the intended use of the fluid contained in said fluid storage container.

4. In a shipping and storage carton as defined in claim 3 the further improvement comprising an inclined surface within said rigid container supported by a downwardly extending leg engaging the bottom wall of said rigid container at the rear of said rigid container, said inclined surface providing bottom support for said fluid storage container to facilitate gravity flow of substantially the entire contents of said fluid storage container toward said spigot.

5. In a shipping and storage carton as defined in claim 2 the further improvement comprising an inclined surface within said rigid container supported by a downwardly extending leg engaging the bottom wall of said rigid container at the rear of said rigid container, said inclined surface providing bottom support for said fluid storage container to facilitate gravity flow of substantially the entire contents of said fluid storage container toward said spigot.

6. In a shipping and storage carton as defined in claim 1 the further improvement comprising an inclined surface within said rigid container supported by a downwardly extending leg engaging the bottom wall of said rigid container at the rear of said rigid container, said inclined surface providing bottom support for said fluid storage container to facilitate gravity flow of substantially the entire contents of said fluid storage container toward said spigot.

7. In a shipping and storage carton for fluid materials of the type comprising a sealed, collapsible, nonpermeable bag-like fluid storage container housed and supported within an essentially rigid box-like container adapted for flat shelf storage and a dispensing spigot connected to said fluid container and accessible outside said rigid container, the improvement comprising: a storage compartment provided within said rigid container separated from said fluid container by an essentially rigid wall separating and excluding said fluid container from said storage compartment, said storage compartment being accessible from the exterior of said rigid container without disturbing said fluid container; a portable dispenser of smaller capacity than said fluid container adapted to be removably housed in said storage compartment and to be filable and refilable with fluid from said fluid container through said dispensing spigot; a window in said rigid container exposing at least a portion of said fluid storage container to view from outside said rigid container; said fluid storage container being of a material transmissive of a color of the fluid stored therein at least in said portion viewable through said window; at least a portion of said spigot being comprised of a material transmissive of the color of fluid contained in said storage container; said portable dispenser comprised of a material transmissive of the color of fluid contained therewithin such that the color of fluid in said portable dispenser may be visually compared with the color of the fluid in said fluid storage container and with the color of the fluid at said spigot.

8. In a shipping and storage carton as defined in claim 7 the further improvement wherein labelling materials are affixed to said rigid container and to said portable dispenser having coloring identifiably the same as the color of fluid in said storage container.

9. In a shipping and storage carton as defined in claim 8 the further improvement wherein labelling materials are affixed to said rigid container and to said portable dispenser having pictorial illustration of the intended use of the fluid contained in said fluid storage container.

10. In a shipping and storage carton as defined in claim 7 the further improvement comprising an inclined surface within said rigid container supported by a downwardly extending leg engaging the bottom wall of said rigid container at the rear of said rigid container, said inclined surface providing gravity flow of substantially the entire contents of said fluid storage container toward said spigot.

11. In combination a shipping and storage carton for fluid materials comprising a sealed collapsible nonpermeable bag-like fluid storage container containing a fluid of an arbitrary color distinctive of the composition and intended use of said fluid, said fluid container being housed and supported for shipment and storage within an essentially rigid box-like container having a flat bottom panel adapted for flat shelf storage, a dispensing spigot connected to said fluid container and accessible outside said rigid container, a storage compartment provided within said rigid container separated from said fluid container by an essentially rigid wall, said storage compartment being accessible from the exterior of said rigid container without disturbing said fluid container, a portable dispenser container of smaller capacity than said fluid container adapted to be removably housed in said storage compartment and to be fillable and refillable with fluid from said fluid container through said dispensing spigot, a window in said rigid container exposing a portion of said fluid storage container, said window and at least a portion of said fluid storage container exposed by said window being sufficiently light transmissive to allow observation of the distinctive color of fluid within said fluid container and at least a portion of said portable dispenser being sufficiently light transmissive to allow observation of the distinctive color of fluid therein and comparison thereof with the distinctive color of the fluid within said storage container.

12. The combination of claim 11, wherein at least a portion of said spigot is sufficiently light transmissive to allow observation of the distinctive color of the fluid within said fluid container.

13. The combination of claim 12 further comprising labelling materials affixed to said rigid container and to said portable dispenser having coloring identifiably the same as the distinctive color of fluid in said fluid storage container and said portable dispenser.

14. The combination of claim 13 further comprising an inclined substantially rigid surface within said rigid container providing bottom support for said fluid storage container, said inclined surface being supported by a downwardly extending leg engaging the bottom wall of said rigid container at the wall of said rigid container opposite said spigot and inclined in a direction causing gravity to urge the contents of said fluid container toward said spigot.

15. The combination of claim 12 further comprising an inclined substantially rigid surface within said rigid container providing bottom support for said fluid storage container, said inclined surface being supported by a downwardly extending leg engaging the bottom wall of said rigid container at the wall of said rigid container opposite said spigot and inclined in a direction causing gravity to urge the contents of said fluid container toward said spigot.

16. The combination of claim 11 further comprising labelling materials affixed to said rigid container and to said portable dispenser having coloring identifiably the same as the distinctive color of fluid in said fluid storage container and said portable dispenser.

* * * * *

UNITED STATES PATENT AND TRADEMARK OFFICE

CERTIFICATE OF CORRECTION

PATENT NO. : 5,085,346

DATED : February 4, 1992

INVENTOR(S) : WRIGHT

It is certified that error appears in the above-identified patent and that said Letters Patent is hereby corrected as shown below:

In Column 6, line 2 after "providing" add -- bottom support for said fluid storage container to facilitate --.

Signed and Sealed this

Fifteenth Day of June, 1993

*Attest:*

Michael K. Kirk

MICHAEL K. KIRK

*Attesting Officer*

*Acting Commissioner of Patents and Trademarks*